US009285189B1

(12) United States Patent
Zhang et al.

(10) Patent No.: US 9,285,189 B1
(45) Date of Patent: Mar. 15, 2016

(54) INTEGRATED ELECTRONIC SIGHT AND METHOD FOR CALIBRATING THE RETICLE THEREOF

(71) Applicant: Huntercraft Limited, Albany, NY (US)

(72) Inventors: Lin Zhang, Albany, NY (US); Chunhua Shi, Albany, NY (US); Sang Su, Albany, NY (US)

(73) Assignee: HUNTERCRAFT LIMITED, Albany, NY (US)

( * ) Notice: Subject to any disclaimer, the term of this patent is extended or adjusted under 35 U.S.C. 154(b) by 0 days.

(21) Appl. No.: 14/676,584

(22) Filed: Apr. 1, 2015

(51) Int. Cl.
*F41G 1/00* (2006.01)
*F41G 1/54* (2006.01)
*F41G 3/06* (2006.01)

(52) U.S. Cl.
CPC ... *F41G 1/54* (2013.01); *F41G 3/06* (2013.01)

(58) Field of Classification Search
USPC ..... 235/400, 404
See application file for complete search history.

(56) References Cited

U.S. PATENT DOCUMENTS

| | | | | |
|---|---|---|---|---|
| 7,913,440 | B2 * | 3/2011 | Murg | F41G 1/38 42/122 |
| 2008/0163504 | A1 * | 7/2008 | Smith | G01C 21/20 33/268 |
| 2013/0040268 | A1 * | 2/2013 | Van der Walt | F41A 33/06 434/16 |
| 2014/0075821 | A1 * | 3/2014 | Li | F41G 1/38 42/130 |
| 2015/0153137 | A1 * | 6/2015 | Newzella | F41G 1/01 42/140 |
| 2015/0268459 | A1 * | 9/2015 | Zheng | G02B 23/145 359/422 |

* cited by examiner

*Primary Examiner* — Christle I Marshall
(74) *Attorney, Agent, or Firm* — Novick, Kim & Lee, PLLC; Allen Xue

(57) ABSTRACT

The present disclosure provides an electronic sight comprising a lens assembly, an image sensor, a processor, a memory, a touch screen, an information acquisition device, a night vision device, a laser ranging device, a video recorder and a Global Positioning System (GPS). The disclosure also provides a method for calibrating the reticle. A plurality of devices are highly integrated on the electronic sight to achieve a plurality of different functions including automatic adjusting magnification, night vision, providing optimal shooting image and laser ranging. The calibration method disclosed in the present invention comprises simulative calibration and pre-shooting calibration, which avoids wasting bullets in a situation that the point of impact cannot be identified after first shot. Reticles can be adjusted in real-time, achieving the same technical effect as non-polar reticles.

26 Claims, 15 Drawing Sheets

INTEGRATED ELECTRONIC SIGHT AND METHOD FOR CALIBRATING THE RETICLE THEREOF

FIELD OF INVENTION

The present invention relates to the field of target shooting, and in particular an electronic sight and method for calibrating the reticle.

BACKGROUND OF INVENTION

Traditional sights include mechanical sights and optical sights. The mechanical sight refers to the metal sight, comprising a rear sight, a front sight and a notch, to assist aiming. The optical sight produces images using optical lens, with the target image and the line of sight superimposed on a same focal plane. Slight eye offset does not affect the aiming point.

In the shooting process, both two traditional sights need to calibrate the reticle and the point of impact repeatedly, so that the point of impact and the reticle center coincide with each other, which requires repeatedly adjusting the knob, or other mechanical parts. After long-term use, either the knob or other mechanical parts will be worn, resulting in error. However, long-range shooting demands high-level of aiming accuracy. A slight sight error will cause great variation on shooting results. The shortcoming is extremely inconvenient in practical applications.

A number of new technologies related to sights have been developed to help users to precisely aim. For example, when users hunt or shoot at night, the night vision function can be applied on sights, helping the users to search for objects more accurately, to shoot more easily. Currently available sights with night vision capabilities mostly include at least one objective lens, an optical enhancement device and an eyepiece lens. The objective lens forms an image of the external scenery on the entrance window of the optical enhancement device. The optical enhancement device increases the brightness of the images and display the same, enhancing the night vision capability. However, the increasing brightness from background to targeted object leads to decreased distinction in brightness between the boundary of targeted object image and background. As a result, the boundary of night image is blurred. Shooters can only obtain the position and orientation of the targeted object, as opposed to the best aiming point. They have to rely on their own experience to determine the best aiming point, which is hard to achieve and instable in shooting accuracy.

Currently available sights have a magnification adjustment function to switch magnification, helping users to observe targeted object clearly and improve shooting accuracy. Most of the magnification adjustment functions can only be achieved manually. However, in shooting practice, users have to manually twist the magnification adjustment ring continuously. Either the hand holding the butt of the gun or the other hand holding the trigger has to be freed up to operate the magnification adjustment ring. As such, aiming and shooting actions cannot be achieved simultaneously, affecting shooting accuracy.

When a sight is attached to the barrel of a firearm for the first time, the barrel needs to calibrated or zeroed, which is usually done by trial and correction. For example, one person at a known distance to the target can launch one or more bullets. Then determine the offset between the landed bullet and the location originally targeted. Then make sight adjustments to eliminate bias. Repeat the whole process until the bullet hole and the original targeted location coincide with each other. However, new calibration has to be performed before the actual hunting or other applications as the initial calibration was done in a particular environment. In the actual hunting process, the actual environmental factors, including temperature, pressure, humidity, wind speed and direction will apply friction on bullets, affecting the trajectory of ballistic. Furthermore, the targeted object is usually at a different distance compared to the distance of the initial calibration. In the process of calibration, after launching a bullet, it is common that the bullet is off target or the point of impact cannot be found on the display of the sight. It's a waste of time and bullets. Experienced users can rely on shooting experience to perform initial calibration, but beginners usually have no clue at all.

SUMMARY OF INVENTION

In the light of the above-mentioned technical problems, the present invention discloses a highly integrated electronic sight and method for calibrating the reticle comprising simulative calibration step, initial calibration step and pre-shooting calibration step. Initial calibration is performed based on the calculated point of impact from simulative calibration. The present invention substantially overcomes the impact of the shooting environment and human errors so that even beginners can easily, simply achieve precise shooting. Reticles can be adjusted in real-time achieving the same technical effect as non-polar reticles.

The present invention refers to an electronic sight comprising a lens assembly, an image sensor, a processor, a memory, a touch screen, an information acquisition device, a night vision device, a laser ranging device, a video recorder and a Global Positioning System (GPS). The lens assembly and night vision device capture images of target and send them to the image sensor. The image sensor converts light signals to microelectronic signals and sends them to the processor. The processor receives the microelectronic signals and sends them to the touch screen. The information acquisition device collects temperature information, humidity information and wind direction and speed information and sends them to the processor. The laser ranging device measures distance between the target and the sight and send it to the processor. The GPS collects the latitude and longitude coordinates and provides gravity coefficients corresponding to the latitude and longitude coordinates. The memory stores volume, mass, velocity, bullet trajectory collide tables and other information of various types of bullets. The processor imports information stored in memory.

In a further aspect of the present invention, the lens assembly comprises a rotating chamber, a boss chamber and a telescopic tube. The rotating chamber comprises a rotating portion and a non-rotating portion. The rotating portion and the non-rotating portion are connected through a bearing. One end of the telescopic tube is connected to the non-rotating portion of the rotating chamber, and the other end of the telescopic tube is connected to the boss chamber. The non-rotating portion of the rotating chamber comprises a group of reference lenses. The rotating portion of the rotating chamber comprises an outer orbit. The boss chamber comprises a plurality of adjustable lens groups and an inner orbit. The position of the inner orbit is related to the position of the outer orbit. The outer orbit is surrounded by the inner orbit. The rotating portion of the rotating chamber is connected to an adjusting unit. The adjusting unit provides a rotational force to the rotating portion. The adjusting unit comprises a driving chip, an adjustable resistor, a microcontroller and an automatic adjusting unit. The automatic adjusting unit is connected to the processor, receives instructions and adjusts the adjustable resistor. The adjustable portion of the adjustable resistor is connected to the microcontroller. The microcontroller receives electrical signals upon changes in adjustable resistance and provides drive signals to the driving chip. The driving chip provides driving force to the rotating chamber after receiving the drive signals.

The information acquisition device of the present invention comprises a wireless receiving unit and a group of sensors. The wireless receiving unit is fixed on upper side of the middle part of the lens assembly and connected to the processor. It is connected to the group of sensors wirelessly. The group of sensors comprises wind direction and speed sensors, temperature sensors and humidity sensors.

Further, the present invention discloses a night vision device rotarily engaged to the bottom side of the front end of the lens assembly. The night vision device with a thickness of 1 cm-3 cm is placed on the inner side of the laser ranging device. The night vision device comprises an infrared receiving unit, an infrared emitting unit, a photoresistor and a printed circuit board (PCB). The infrared receiving unit, infrared emitting unit and photoresistor are all mounted on the PCB by surface-mount technology (SMT). The PCB board is connected to the processor. The infrared emitting unit emits infrared light on targeted object. The infrared receiving unit receives the reflected infrared light. The photoresistor detects the light intensity value of the environment where the targeted object and the sight are located in order to determine whether to turn on the night vision device. The night vision device disclosed in the present invention can perform pseudocolor processing to provide the optimal shooting area.

Further, the disclosed laser ranging device is fixed to the front end of the lens assembly. The laser ranging device comprises a laser emitting unit, a laser receiving unit, a laser central unit, a laser control device and power components. The laser emitting unit and laser receiving unit are fixed to each side of the front end of the lens assembly. The laser emitting unit, laser receiving unit and laser control device are connected to the laser central unit. The laser central unit is connected to the processor.

Further, the disclosed electronic sight also comprises a video recorder, a control panel, a USB interface, a NTSL/PAL video interface and a recognition system. The video recorder is rotarily engaged to the bottom side of the middle part of the lens assembly. The video recorder with a thickness of 3 cm-5 cm is placed on the inner side of the night vision device.

The present invention discloses a method of calibrating the reticle precisely. The calibration method comprises the steps of:

A. Set a targeted object at a distance from the electronic sight;

B. Obtain a first rectangular coordinate system through the operation panel, letting the first rectangular coordinates superimposed on the image of the targeted object displayed on the touch screen, and set the origin of the first rectangular coordinate system at the center point of the touch screen;

C. Observe the image of the targeted object through the touch screen, and aim at the targeted object through the origin of the first rectangular coordinate system;

D. The processor receives the value of wind direction and speed, temperature and humidity provided by the information acquisition device, the latitude and longitude information provided by the GPS, the gravity factor of the latitude and longitude, the volume, mass and speed of the bullet provided by the memory, the distance between the target and the sight provided by the laser ranging device;

E. Calculate the bullet offset based on the following ballistic curve model in the processor $$Y = \left[ \frac{V_1 L * \sin\varphi}{V_1 * \cos\varphi - \sqrt{\frac{8kC \cdot SPL}{\pi \cdot M}} + V_4} + \left(\frac{1}{2}g + \frac{SPV_2}{M}\right) \cdot \left( \frac{L}{V_1 * \cos\varphi - \sqrt{\frac{8kC \cdot SPL}{\pi \cdot M}} + V_4} \right)^2 \right] \cdot \gamma$$

$$X = \frac{SPV_3}{2M} \cdot \left( \frac{L}{V_1 * \cos\varphi - \sqrt{\frac{8kC \cdot SPL}{\pi \cdot M}} + V_4} \right)^2 \cdot \beta$$

F. Obtain the point of impact based on the calculated bullet offset, and identify the point of impact on the screen;

G. Determine the opposite value of the point of impact on the first rectangular coordinate system based on the calculated point of impact, click on the opposite value on the touch screen to shift the origin of the rectangular coordinate system to the opposite value, and shift the calculated point of impact to the center point of the touch screen display to finish simulative calibration;

H. Withdraw the first rectangular coordinate system and its origin, create a second rectangular coordinate system via the operation panel, the origin of the second rectangular coordinate system coincides with the calculated point of impact, fire a bullet and observe the first bullet hole on the touch screen, lock the display by pressing a key for screen lock on the operation panel;

I. Identify the corresponding bullet hole position on the touch screen display;

J. Obtain the coordinate of the first bullet hole on the second rectangular coordinate system;

K. Obtain the opposite value of the coordinate of the first bullet hole on the second rectangular coordinate system;

L. Click on the opposite value on the touch screen to shift the origin of the rectangular coordinate system to the opposite value, and then release the screen lock;

M. Aim at the target with the shifted origin;

N. Fire a second bullet, the second bullet hole coincides with the first bullet hole on the touch screen in theory;

O. Clear the rectangular coordinate system on the touch screen;

P. Click on the second bullet shown on the touch screen, shifting the central point of the reticle to the clicked position, and then release the screen lock to finish pre-shooting calibration.

There are many advantages to the present invention. The video recorder, night vision device, information acquisition device, laser ranging device and a variety of other auxiliary devices are highly integrated on the electronic sight with optimized installation position and the connection means. This integration enables the electronic sight to achieve a plurality of different functions, helping the users to adapt to various shooting environments. By using the lens assembly of the present invention, performing frame selection on the touch screen and giving adjusting instructions, the target can be automatically enlarged to adapt to the size of the touch screen, which is both convenient and stable. After obtaining night image from the electronic site with night vision function, optimal shooting images are automatically generated and processed through pseudocolor image processing to improve color difference between shooting images and the background image, such that optimal shooting images can be easily distinguished for accurate shooting. The calibration method disclosed by the present invention calculates the point of impact at the first step, then shifts the touch screen to the calculated point of impact, and then perform a pre-shooting calibration, which avoids wasting bullets in an situation that the point of impact cannot be identified after first shot. Reticles can be adjusted in real-time achieving the same technical effect as non-polar reticles.

The calibration method can adjust reticles in real-time, achieving the same technical effect as non-polar reticles.

The following detailed description of figures describes various embodiments and their features in detail.

DETAILED DESCRIPTION OF THE PREFERRED EMBODIMENTS

The objective, technical solutions and advantages of the present invention will be more apparent by describing in detail exemplary embodiments thereof with reference to the figures. It should be understood that the specific embodiments described herein are only intended to illustrate the present invention and are not intended to limit the present invention.

The present invention includes within its scope all embodiments defined by the appended claims including alternatives, modifications, equivalent method and solutions. Further, for clearer understanding the present invention, specific details are described below.

Figure 1:
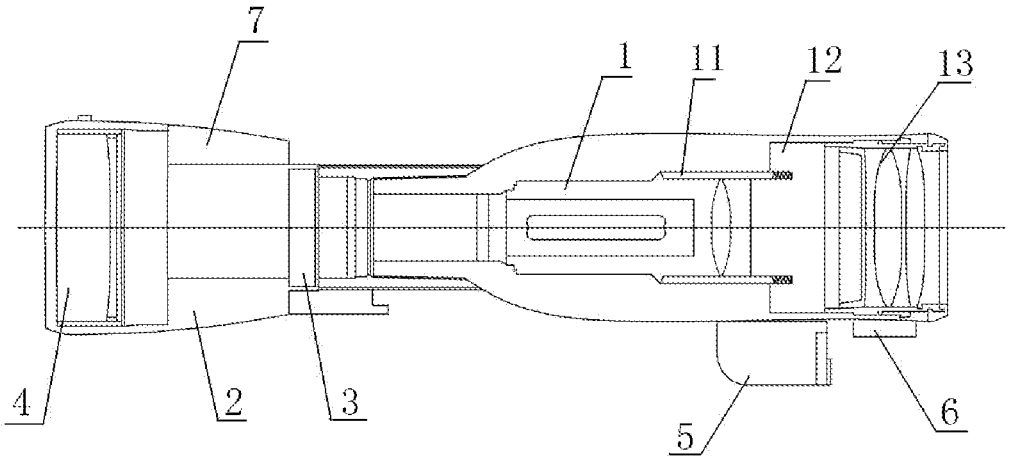
FIG. 1 is a schematic view of an electric sight according to an embodiment of the present invention.

FIG. 1 shows a schematic view of an electric sight comprising a lens assembly 1, an image sensor 3, a processor 2, a memory, a touch screen display 4, an information acquisition device, a night vision device 6, a laser ranging device, a video recorder 5 and a Global Positioning System (GPS). The lens assembly 1 and night vision device 6 are connected to the image sensor 3. The image sensor 3, information acquisition device, laser ranging device, touch screen display 4 and GPS are connected to the processor 2. The video recorder 5 is connected to the memory.

The lens assembly 1 and night vision device 6 capture images of targets and send the images to the image sensor 3. The image sensor 3 receives the images sent by the lens assembly 1 and night vision device 6 and converts light signals to microelectronic signals and sends them to the processor 2. The processor 2 receives the microelectronic signals and sends them to the touch screen 4. The processor 2 also receives various environment information sent by the information acquisition device, the distance information between the target and the sight sent by the laser ranging device and location information sent by the GPS. All these information are sent to the touch screen to display. The various environment information include wind speed, humidity and temperature. The processor 2 reads the stored information in the memory. The video recorder 5 records the whole process of hunting and sends to the memory to store.

The video recorder 5, night vision device 6 and laser ranging device are all attached to the sight. The laser ranging device is placed on the front end of the lens assembly. The night vision device 6 with a thickness of 1 cm-3 cm is placed on the inner side of the laser ranging device and rotarily engaged to the bottom side of the front end of the lens assembly 1. The video recorder 5 with a thickness of 3 cm-5 cm is placed on the inner side of the night vision device and rotarily engaged to the bottom side of lens assembly 1. This arrangement avoids the problem of the video recorder 5 being blocked by the night vision device 6. By adjusting the location and connection means of the video recorder 5, night vision device 6 and laser ranging device, a variety of auxiliary equipments is highly integrated on the sight, achieving a plurality of different functions, helping the users to adapt to various shooting environments.

The electronic sight of the present invention can automatically adjust the magnification.

Figure 2:
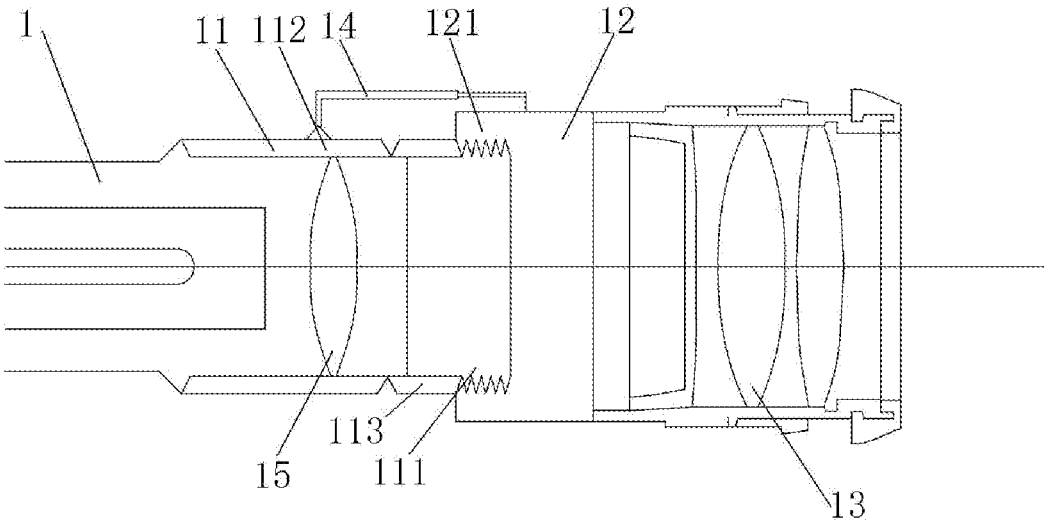
FIG. 2 is a schematic view of the lens of the electric sight according to an embodiment of the present invention.

FIG. 2 shows a schematic view of the lens of the electric sight. The lens assembly 1 comprises a rotating chamber 11, a boss chamber 12 and a telescopic tube 14. The rotating chamber comprises a rotating portion 113 and a non-rotating portion 112. The rotating portion 113 and the non-rotating portion 112 are connected through a bearing. The rotating portion 113 of the rotating chamber 11 is rotarily connected to the boss chamber 12. One end of the telescopic tube 14 is connected to the non-rotating portion of the rotating chamber 11, and the other end of the telescopic tube 14 is connected to the boss chamber 12. The telescopic tube is stretchable. The non-rotating portion 112 of the rotating chamber 11 comprises a group of reference lenses 15. The rotating portion 113 of the rotating chamber 11 comprises an outer orbit 111. The outer orbit 111 is disposed at a junction between the rotating portion 113 and the boss chamber 12.

The boss chamber 12 comprises a plurality of adjustable lens groups 13 and an inner orbit 121. The inner orbit 121 is disposed at a junction between the boss chamber 12 and the rotating chamber 11. The position of the inner orbit 121 is related to the position of the outer orbit 111. The outer orbit 111 is surrounded by the inner orbit 121. When the rotating portion 113 of the rotating chamber 11 rotates, the outer orbit 111 rotates. However, the inner orbit 121 cannot rotate with the restriction of the telescopic tube 14, creating relative motion between the boss chamber 12 and the rotating chamber 11. The overall magnification of the lens is effectively changed by changing the distance of the boss chamber 12 and rotating chamber 11 through rotational action.

Figure 3:
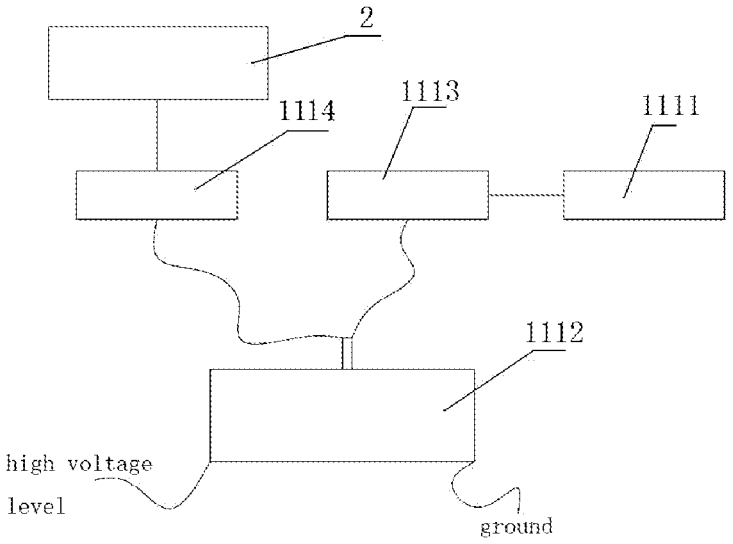
FIG. 3 is a schematic view of the calibration unit of the electric sight according to an embodiment of the present invention.

FIG. 3 shows a schematic view of the calibration unit of the electric sight. The rotating portion 113 of the rotating chamber 11 is connected to an adjusting unit. The adjusting unit provides a rotational force to the rotating portion 113 of the rotating chamber 11. The adjusting unit comprises a driving chip 1111, an adjustable resistor 1112 and a microcontroller 1113. The adjustable portion of the adjustable resistor 1112 is connected to the input port of the microcontroller 1113. The output port of the microcontroller 1113 is connected to the driving chip 1111. The driving chip 1111 drives the rotating chamber 11 to rotate. The adjustable portion of the adjustable resistor 1112 automatically adjusts the output port of the automatic adjusting unit 1114. One end of the non-adjustable portion of the adjustable resistor 1112 is grounded. The other end of the non-adjustable portion of the adjustable resistor 1112 is connected to a high voltage level. The high voltage level is connected to a power supply. The automatic adjusting unit 1114, comprising an input port connected to the processor 2 receives automatic adjusting signals from the processor 2.

Users can apply the electronic sight for aiming and shooting both stationary and non-stationary objects. For aiming stationary objects, identify the image of the targeted object through the touch screen 4 at the first step. And then frame select the targeted object, aiming the sight to the targeted object. The area of the selected frame is r. The processor 2 receives the frame area r on the touch screen 4, obtains the magnification R/r based on the display area R of the touch screen, generates automatic adjusting signals and sends the automatic adjusting signals to the automatic adjusting unit 1114. The automatic adjusting unit 1114 controls the adjustable portion of the adjustable resistor 1112 to change the resistance of the adjustable resistor 1112. After the change, the current obtained by the microcontroller 1113 is altered by R/r times. The microcontroller 1113 generates driving signal and sends it to the driving chip 1111. The driving chip 1111 receives driving signal and provides driving force to rotate the rotating chamber 11 and boss chamber 12, ultimately changes the magnification.

For aiming non-stationary objects, identify the image of the targeted object through the touch screen 4 at the first step. The moving direction and speed need to be considered when users frame select the targeted object. The frame area needs to be enlarged for easy observation and shooting. Then go through the same process for aiming stationary objects after frame selection.

By performing frame select on the touch screen and giving adjusting instructions, the target can be automatically enlarged to adapt to the size of the touch screen, which is convenient and stable.

The electronic sight of the present invention has a night vision function.

The night vision device 6 is attached to the bottom side of the front end of the lens assembly, which is also the bottom side of the front end of the boss chamber. The night vision device 6 comprises an infrared receiving unit, an infrared emitting unit, a photoresistor and a printed circuit board (PCB). The infrared receiving unit captures the optical image of the targeted object. The infrared emitting unit emits infrared light. The infrared emitting unit, infrared receiving unit, photoresistor and PCB are all mounted on the holder of the night vision device. The holder is attached to the lens assembly. The infrared emitting unit, infrared receiving unit, and photoresistor are all mounted on the PCB by surface-mount technology (SMT). The PCB board is connected to the processor. The photoresistor detects the light intensity value of the environment where the targeted object and the sight are located in order to determine whether to turn on the night vision device. The light intensity threshold value is 0.3 lux for turning on the night vision function. The infrared emitting unit emits infrared light on targeted object. The infrared receiving unit receives the reflected infrared light.

Pseudocolor processing converts grayscale image captured by the night vision device 6 to color image. The pseudocolor processing comprises the following steps:

1. Divide the touch screen into n×m square units of the same size. The side length of the square unit is l. The width of the touch screen is n×l. The length of the touch screen is m×l. Both n and m are integers greater than or equal to 100;

2. Edge extraction: The night vision device obtains the image and displays it on the touch screen. The image of the targeted object is brighter than the background image. As such, the brightness of two mutually adjacent square units could be compared. When the brightness differs by more than 0.08 lux, mark the square unit with higher brightness. All the marked square units build up the marked image area, which is the image area of the targeted object;

3. Fill color to the image area of the targeted object. Fill the non-targeted areas with another color of big difference. For example, fill blue color to the image area of the targeted object, another color with a color difference ΔE more than 4.0 such as yellow. The color values of yellow and blue differ largely so as to highlight the image area of the targeted object.

4. The touch screen displays the targeted object with an image area of i square units 5. Obtain optimal shooting area s based on the following mathematical model:

$$s = \left(1 - \frac{\sqrt{i}}{n}\right) \cdot i$$

Fill colors to the optimal shooting area and the targeted shooting area with color difference ΔE of more than 2.0. The larger the image area to be targeted, the smaller the ratio of the optimal shooting area to the image area to be targeted. The smaller the image area to be targeted, the larger the ratio of the optimal shooting area to the image area to be targeted. The optimal shooting area is circular. The circular center and the geometric center of the targeted object coincides.

With the night image obtained from the electronic sight of the present invention, optical shooting image is automatically generated, followed by pseudocolor processing. The color difference between the optimal shooting image and background image is improved, such that the optimal shooting image is easily distinguished with higher shooting accuracy.

The electronic sight of the present invention has a ranging function.

Figure 4:
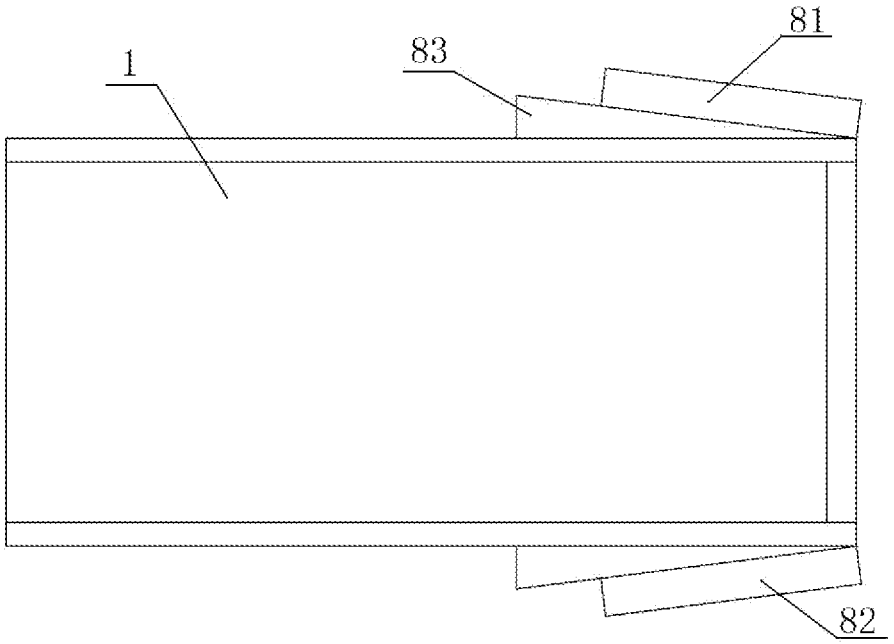
FIG. 4 is a top view of the lens of the electric sight according to an embodiment of the present invention.
Figure 5:
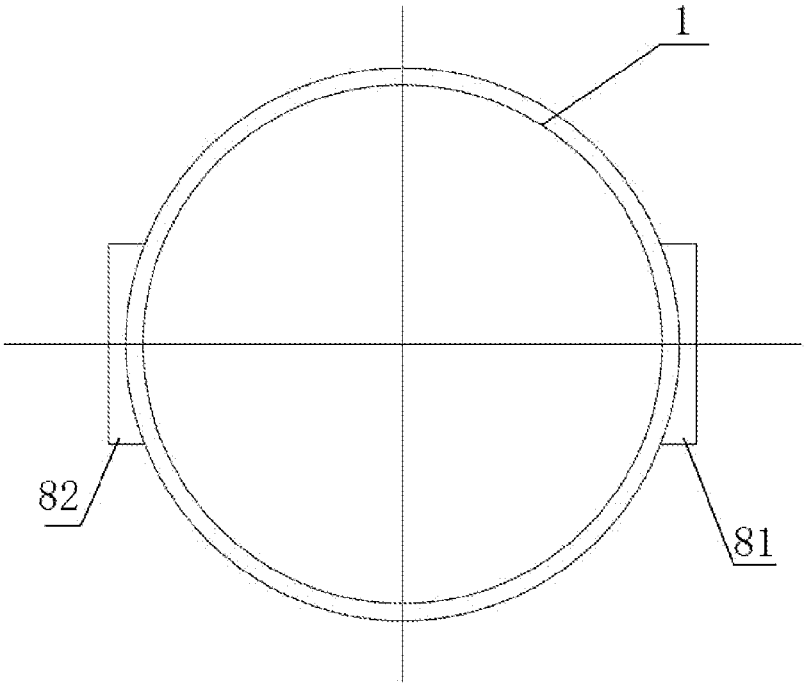
FIG. 5 is a front view of the lens of the electric sight according to an embodiment of the present invention.

As shown in FIG. 4 and FIG. 5, the laser ranging device comprises a laser emitting unit 81, a laser receiving unit 82, a laser central unit, a laser control device and power components. The power components supply power to the laser emitting unit 81, the laser receiving unit 82, the laser central unit and the laser control device. The laser emitting unit 81, laser receiving unit 82, laser control device are all connected to the laser central unit. The laser central unit is connected to the processor and sends ranging signals to the processor. The laser emitting unit 81 and the laser receiving unit 82 are fixed by laser holder 83 on each side of the front end of the lens. The laser holder 83 has a manual knob to adjust angles of the laser emitting unit and the laser receiving unit, converging the lines of laser emitting unit 81 and laser receiving unit 82 to a point in front of the lens 1 of the sight.

Laser is emitted from the laser emitting unit 81 and reflected by the object to be measured, and then received by the laser receiving unit. Laser rangefinder records the time taken in the round-trip. The round-trip time multiplied by the speed of light and divided by 2 is the distance between the laser ranging device and the object to be measured. The error of this method for measuring distance is about 0.1%.

The electronic sight of the present invention has an information acquisition and trajectory simulation function.

Figure 6:
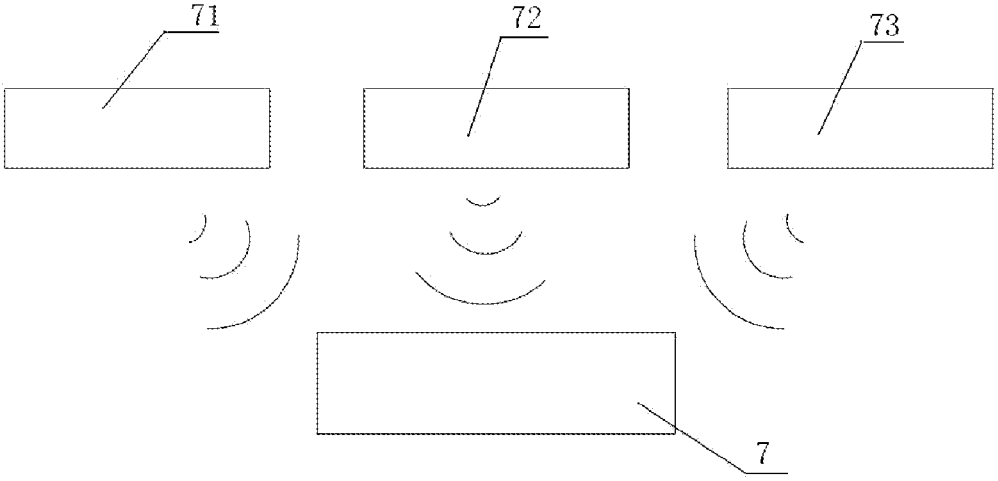
FIG. 6 is a schematic view of the information acquisition device of the electric sight according to an embodiment of the present invention.
Figure 7:
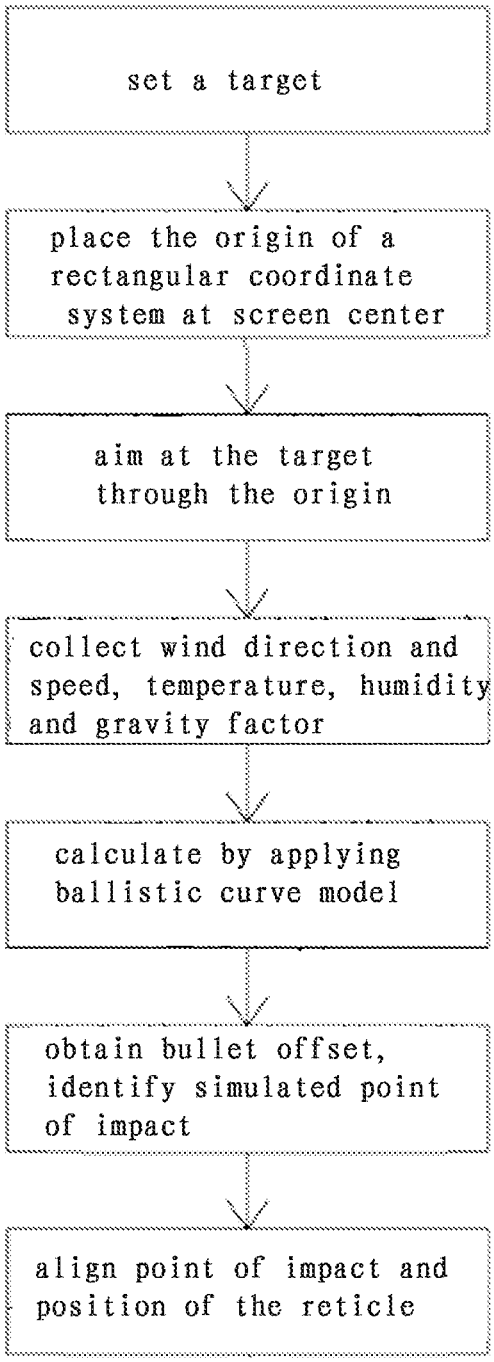
FIG. 7 is a flowchart for a simulative calibration procedure according to an embodiment of the present invention.
Figure 8:
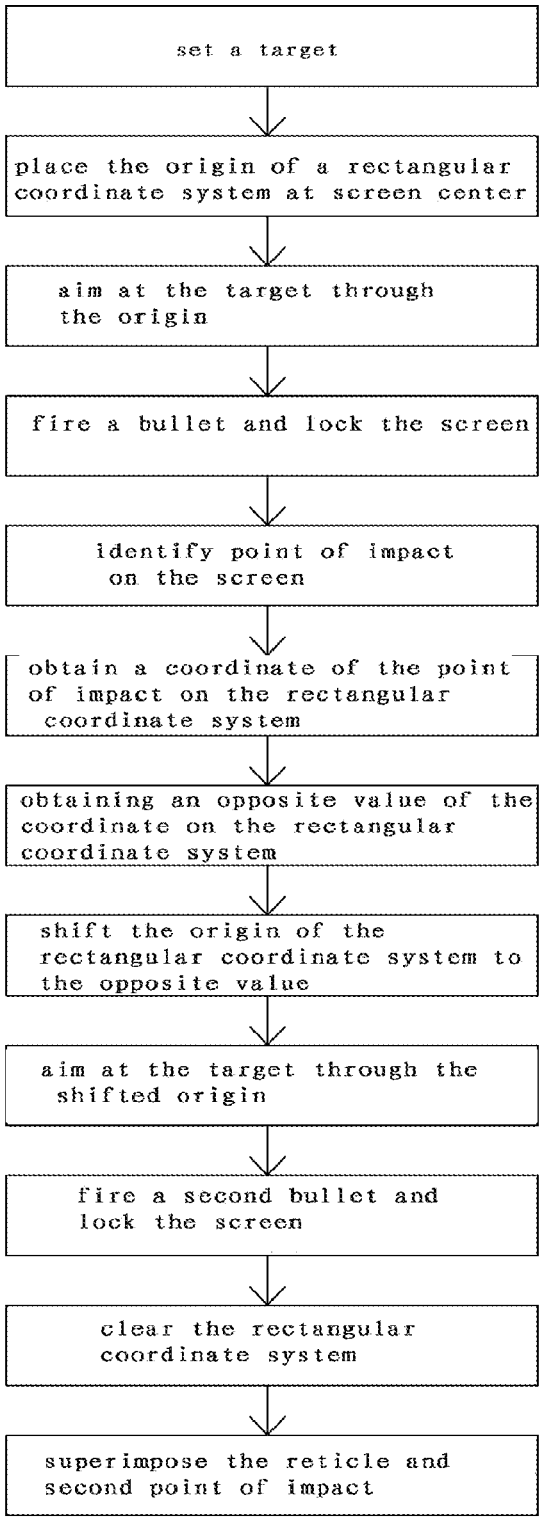
FIG. 8 is a flowchart for a precise calibration procedure according to an embodiment of the present invention.
Figure 9:
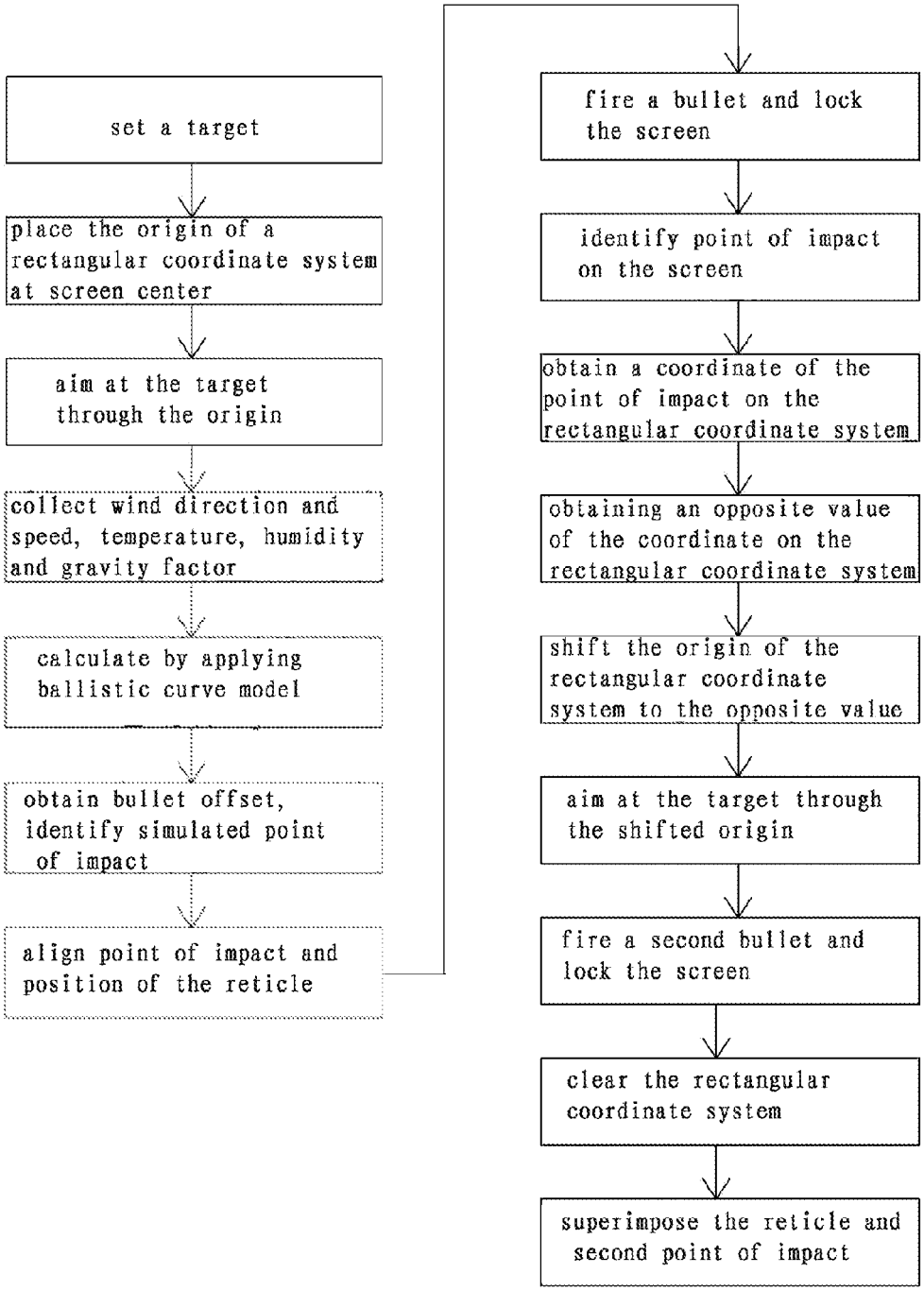
FIG. 9 is a flowchart for a simulative calibration followed by a precise calibration procedure according to an embodiment of the present invention.

FIG. 6 is a schematic view of the information acquisition device of the electric sight. The information acquisition device comprises a wireless receiving unit 7, a wind direction and speed sensor 71, a temperature sensor 72 and a humidity sensor 73. All sensors are connected to the wireless receiving unit 7 wirelessly. The wireless receiving unit 7 is connected to the memory via the processor 2. The wireless receiving unit 7 is attached to the top side of lens assembly. When users operate the sight, the wind direction and speed sensor 71, temperature sensor 72 and humidity sensor 73 send detected wind direction and speed, temperature and humidity values to the wireless receiving unit wirelessly. The wireless receiving unit transmits the received values to the processor and stores it in the memory. The values of the wind direction and speed, temperature and humidity are environmental values, wherein the wind direction and speed value includes horizontal wind speed and vertical wind speed value.

The wind direction and speed sensor 71 is an ultrasonic wind speed and direction sensor, or a sensor with a chip to detect wind speed and direction. The humidity sensor 72 is a current humidity sensor. The temperature sensor is a thermocouple temperature sensor. The wind direction and speed sensor 71, temperature sensor 72 and humidity sensor 73 are connected to the wireless receiving unit 7 by Bluetooth.

The electronic sight of the present invention has recording capabilities and other functions.

The video recorder 5 comprises a video camera. The video camera is engaged to the bottom side of the middle part of the lens assembly and wirelessly connected to the memory. The video camera records the process of shooting or hunting by video recording or photograph recording, and sends the recorded information to a mobile terminal via Bluetooth or USB interface. Pictures and videos can be shared to social networks through the mobile terminal.

The sight also has 3G and wifi communication modules. Images and data can be synchronized to a remote terminal. The remote terminal is connected to the cloud. Users can rate every sight usage and upload the corrected data and other related information to the cloud via remote terminals. The cloud collects the scores and corrected data to analyze in order to continuously improve the sight performance. The remote terminals can be a computer or a tablet. The sight comprises a transmitting operation interface for remote shooting.

The processor has an error analysis module. The error analysis module records the manufacturers of every bullet in the calibration process, displays error distribution on the touch screen, and calculates standard deviation. The error analysis module analyzes stability and reliability of bullets to help users to choose stable and reliable bullet manufactures.

Calculating the standard deviation of error in the calibration process comprises the following steps. Performing a number of N shots, the difference between the actual point of impact and the calculated point of impact by a ballistic curve model in the horizontal direction is the error value. As N shots are performed, N error values are generated in the horizontal direction or the vertical direction. Drop two maximum and two minimum error values in the horizontal direction or the vertical direction and calculate standard deviation of the remaining error values. Compare the standard deviation of various bullet shots among different manufactures, wherein the smaller the standard deviation, the higher the stability of the production.

The touch screen 4 is a liquid crystal display (LCD), or an organic light emitting diode display (OLED), or a liquid crystal on silicon display, but not limited to the above-described displays. The display can be selected according to other needs.

The sight also comprises an operation panel. The operation panel comprises a power switch, a key for main menu, a key for screen lock, a key for reticle brightness, a key for screen brightness, a key for image zoom in and out, and other function keys. The power switch is connected to power supply or a battery charging port. The key for screen lock locks the image of the targeted object. When users shoot and need to observe the point of impact, they can press the key for screen lock to observe images. The key for zoom in and out enlarges or reduces the image size displayed on the screen. The main menu comprises coordinate system, reticle, video and environment value reading. For example, click on the reticle, a submenu pops-up for parameter setting including the reticle type, location, color and shape. The function keys comprise one to switch between aiming a stationary object and a non-stationary object.

The function keys on the operation panel comprise work mode selection key and network key. The work mode selection key switch between calculating continuous function with a ballistic curve model and applying discrete bullet trajectory table stored in the internal memory, giving users more choices. Users can also edit their own ballistic formulas or bullet trajectory table to store in the memory. The network key can achieve sight update or purchase and other value-added services via internet such as shooting guide calling, location-based calibration services and synchronizing global ballistic shooting trajectory correction parameters.

The image sensor 3 is a linear array charge-coupled device (CCD), or a complementary metal oxide semiconductor (CMOS) or other types of sensors.

The sight comprises a USB interface for easy connection to other peripheral devices such as computers, for transferring or importing images or video data.

The sight comprises a NTSL/PAL video interface for playing video.

The sight comprises an identification system for identifying users' biometric information including hand, palm, face, iris, retina, pulse, ear, signature, voice, gait or combination of any of them against unauthorized use. The identification system is connected to the processor. It acquires users' biometric information and sends them to the processor of the sight. Biometric identification information is acquired by the processor to determine whether it matches with the owner of the firearm. If not, then the prompt recognition fails and triggers the deactivation of targeting function; if matches, the prompt recognition is successful, functions can be used normally.

Figure 10:
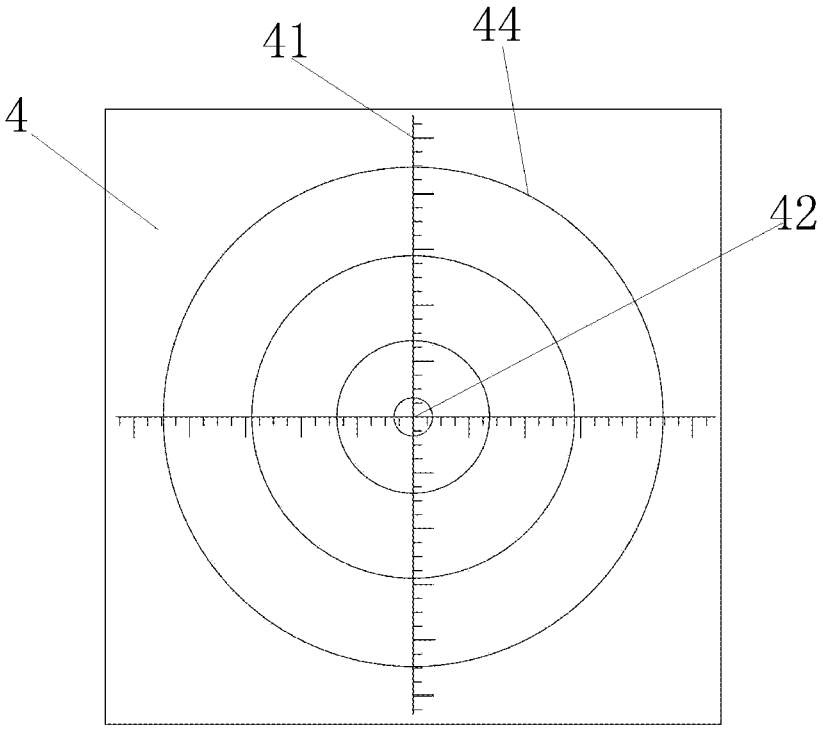
FIG. 10 is a schematic view of the touch screen display before a simulative calibration according to an embodiment of the present invention.

The present invention discloses a method of calibrating the reticle precisely. The calibration method comprises the follow steps:

A. As shown in FIG. 10, observe the targeted object and measure the distance L between the target and the electronic sight by the laser ranging device;

B. Obtain a first rectangular coordinate system 41 through the operation panel, let the first rectangular coordinates superimposed on the image of the targeted object 44 displayed on the touch screen 4, and set the origin 42 of the first rectangular coordinate system 41 at the center point of the touch screen 4;

C. Observe the image of the targeted object through the touch screen 4, and aim at the targeted object through the origin 42 of the first rectangular coordinate system;

D. The processor receives the value of wind direction and speed, temperature and humidity provided by the information acquisition device, the latitude and longitude information provided by the GPS, the gravity factor of the latitude and longitude, the volume, speed and mass of the bullet provided by the memory, the distance between the target and the sight provided by the laser ranging device;

E. Simulate bullet ballistic curve by calculating the bullet offset based on the ballistic curve model in the processor.

Under ideal conditions with only gravity influencing factor, there is no offset of the bullet in the horizontal direction. The offset in the vertical direction is $$V_1 t * \sin\varphi + \frac{1}{2} g t^2$$

Wherein $V_1$ is the speed of the bullet of the current model when fired from the barrel, t is time the bullet spent in the air from firing to reaching the target, $-90° < \phi < +90°$, g is the gravitational coefficients of the corresponding latitude and longitude. However, during actual shooting, bullet offset is affected by many factors such as gravity, wind, temperature, humidity and other factors. Gravity and wind are major are the main factors. Gravity factor is determined by the force of gravity. Wind factor is determined by wind speed and direction. The wind factor can be decomposed to a factor perpendicular to the horizontal plane, a factor on the horizontal plane perpendicular to the shooting direction, and another factor on the horizontal plane parallel to the shooting direction. Temperature and humidity combine to produce air resistance to affect the ballistic curve of bullets. Although bullets are streamlined to reduce the impact of air resistance, the influence of air resistance still needs to be considered in order to improve the accuracy of the simulated bullet ballistic curve.

In the horizontal direction, the offset of the bullet is $\frac{1}{2}at^2$, wherein a is the acceleration which wind exerts a bullet, t is time the bullet spent in the air from firing to reaching the target.

In the present invention, taking into account the above factors affecting the trajectory of the bullet, after testing and fitting, the following ballistic curve calculation model is obtained:

$$Y = \left[ \frac{V_1 L * \sin\varphi}{V_1 * \cos\varphi - \sqrt{\frac{8kC \cdot SPL}{\pi \cdot M^2}} + V_4} + \left(\frac{1}{2} g + \frac{SPV_2}{M}\right) \cdot \left( \frac{L}{V_1 * \cos\varphi - \sqrt{\frac{8kC \cdot SPL}{\pi \cdot M^2}} + V_4} \right)^2 \right] \cdot \gamma$$

$$X = \frac{SPV_3}{2M} \cdot \left( \frac{L}{V_1 * \cos\varphi - \sqrt{\frac{8kC \cdot SPL}{\pi \cdot M^2}} + V_4} \right)^2 \cdot \beta$$

wherein X is the horizontal distance traveled by the bullet, Y is the vertical distance traveled by the bullet. Point of impact can be simulated based on X and Y value. L is the distance between the targeted object and the sight. $\phi$ is the horizontal angle of the barrel at the time of firing, $-90° < \phi < +90°$. $V_1$ is the speed of the bullet of the current model when fired from the barrel. $V_2$ is the wind velocity perpendicular to the horizontal plane, being positive in upward direction. $V_3$ is the wind velocity on the horizontal plane perpendicular to the shooting direction. $V_4$ is the wind velocity on the horizontal plane parallel to the shooting direction, being positive in the shooting direction. g is gravitational coefficient of the corresponding latitude and longitude, being negative in vertically upward direction. C is a thermodynamic temperature constant, namely Boltzmann's constant. S is the volume of the bullet.

M is the mass of the bullet. P is the humidity value of the corresponding environment. The humidity value is the mass of the water vapor (g) per unit volume (cubic meter) of air. $\gamma$ and $\beta$ are empirical coefficients dependent on the distance between the targeted object and the sight. When the distance is less than or equal to 500 meters, $\gamma$ ranges from 0.95 to 0.98, $\beta$ ranges from 0.97 to 0.99. When the distance is greater than 500 meters and less than 1000 meters, $\gamma$ ranges from 0.98 to 1.05, $\beta$ ranges from 1.01 to 1.03. When the distance is greater than 1000 meters and less than 1500 meters, $\gamma$ ranges from 1.05 to 1.10, $\beta$ ranges from 1.07 to 1.08. When the distance is greater than 1500 meters, $\gamma$ ranges from 1.10 to 1.17, $\beta$ ranges from 1.15 to 1.18.

Figure 11:
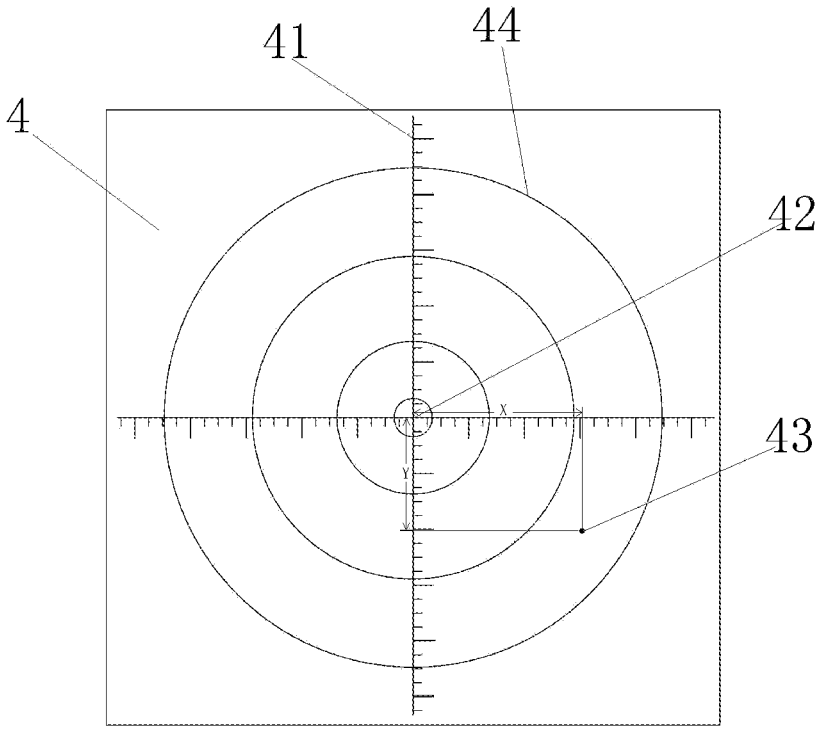
FIG. 11 is a schematic view of the touch screen display with a simulated point of impact according to an embodiment of the present invention.
Figure 12:
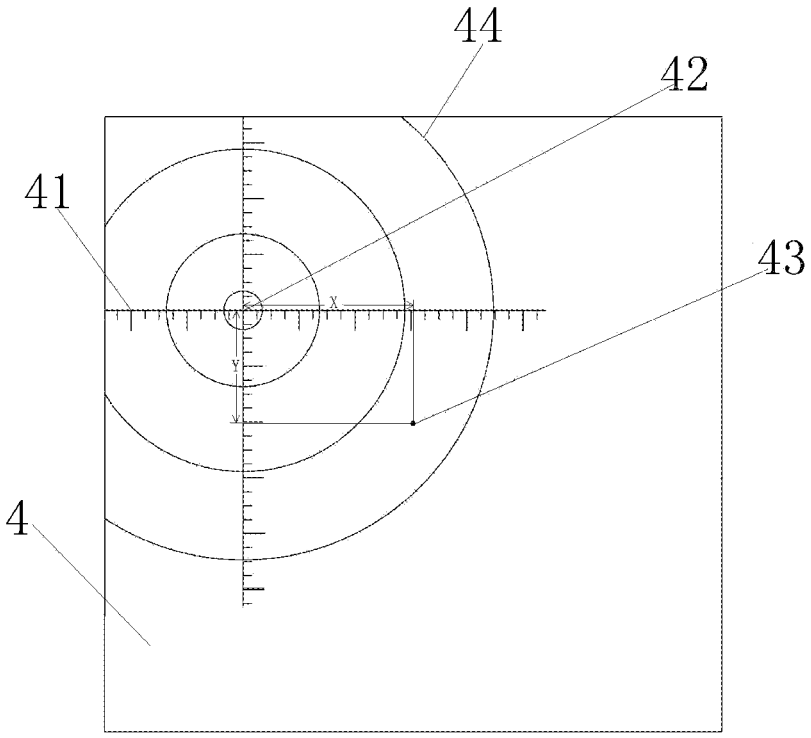
FIG. 12 is a schematic view of the touch screen display after a simulative calibration according to an embodiment of the present invention.
Figure 13:
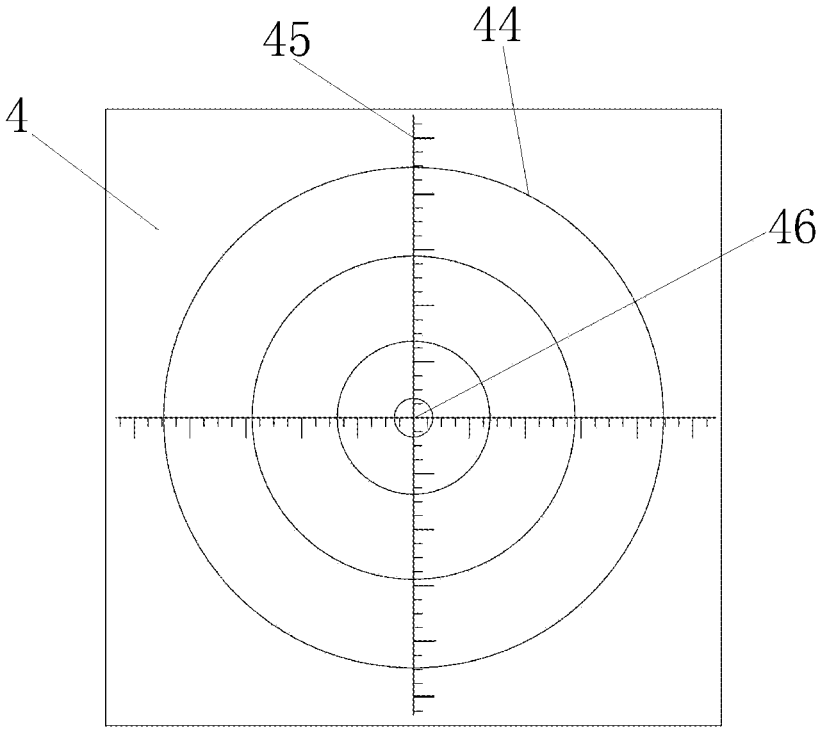
FIG. 13 is a schematic view of the touch screen display before a precise calibration according to an embodiment of the present invention.
Figure 14:
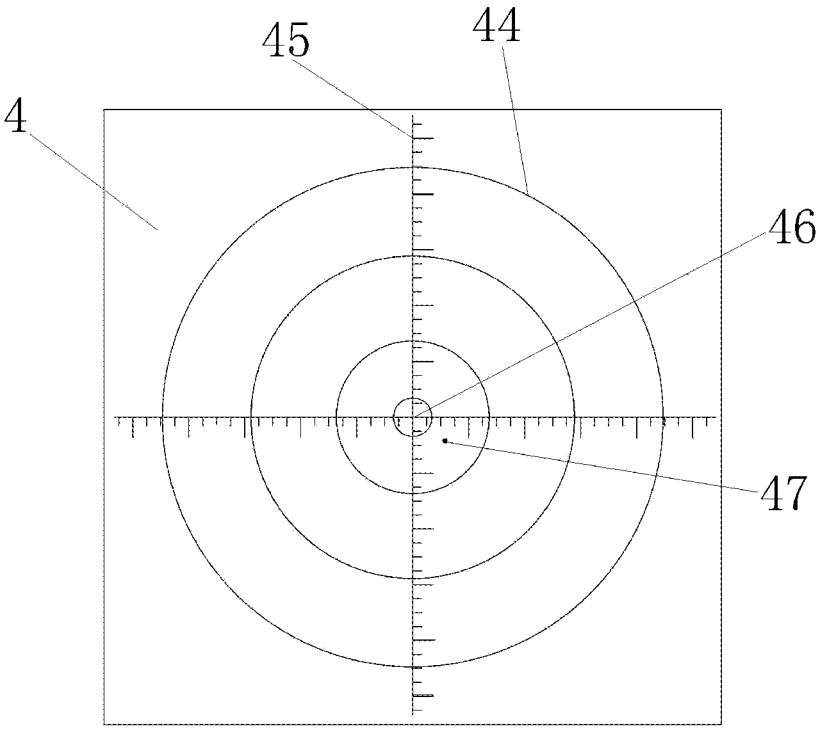
FIG. 14 is a schematic view of the touch screen display with the first point of impact according to an embodiment of the present invention.
Figure 15:
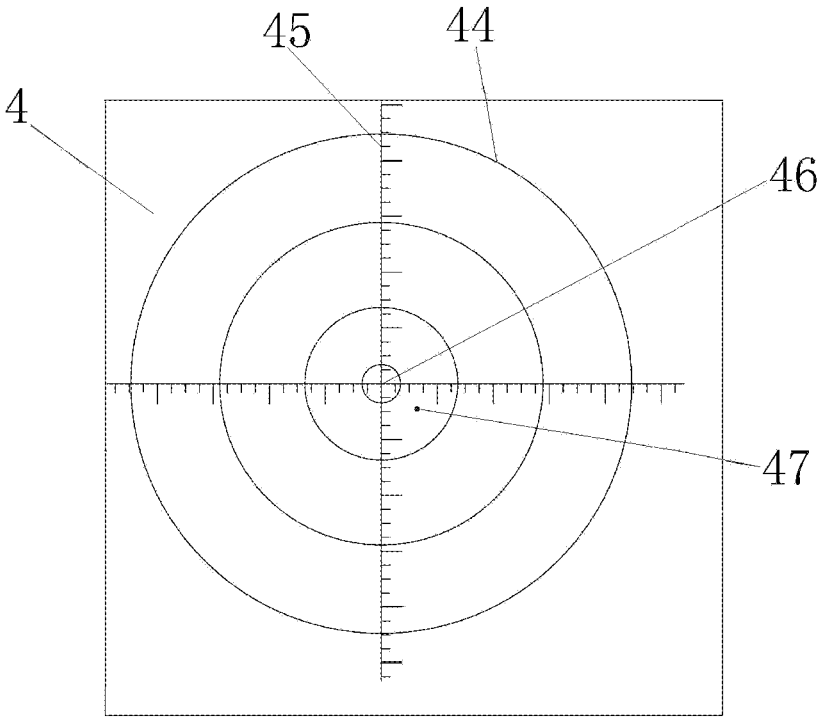
FIG. 15 is a schematic view of the touch screen display after calibration based on the first point of impact according to an embodiment of the present invention.
Figure 16:
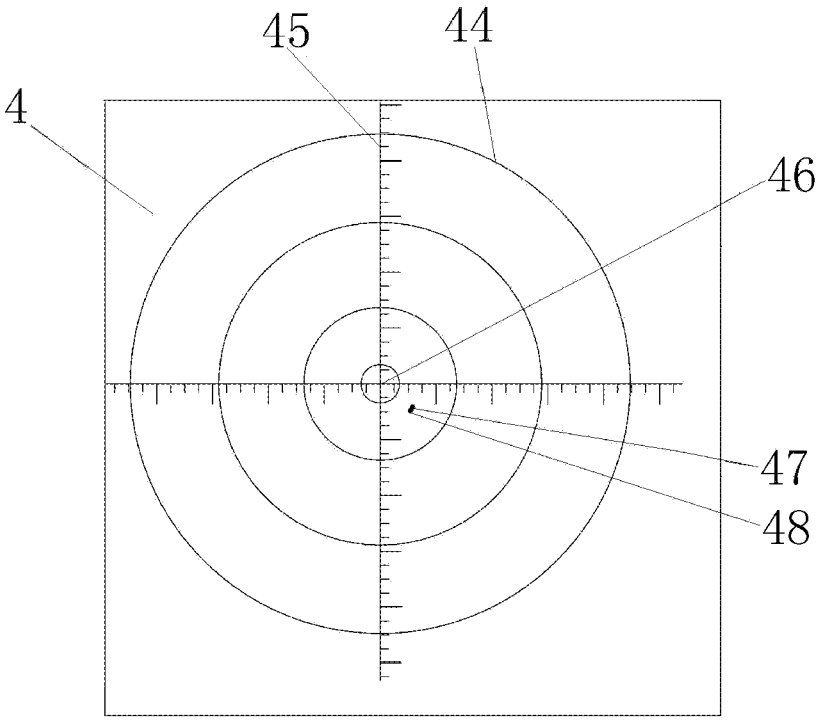
FIG. 16 is a schematic view of the touch screen display with the second point of impact according to an embodiment of the present invention.
Figure 17:
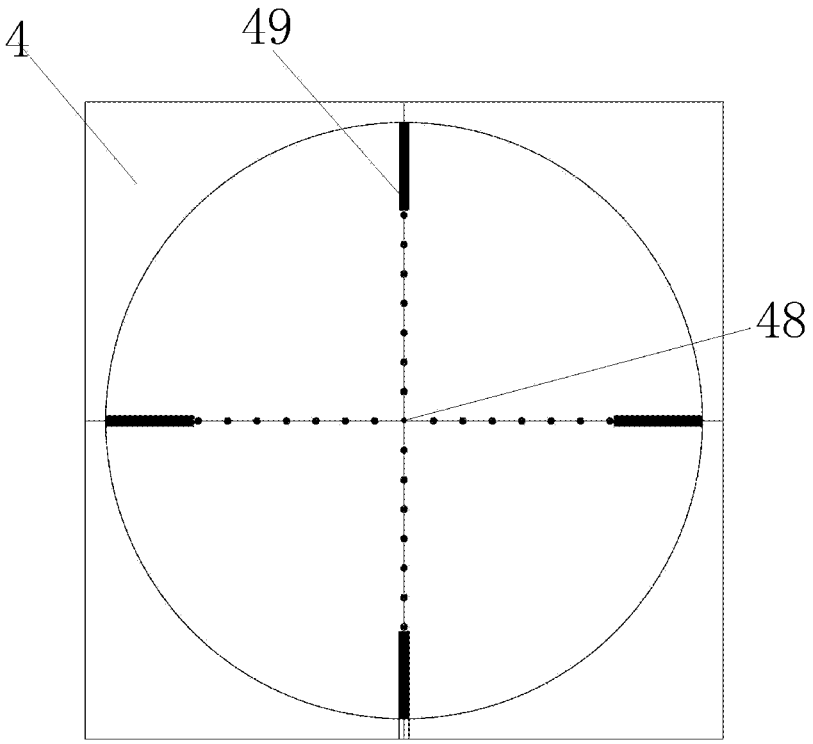
FIG. 17 is a schematic view of the touch screen display after a precise calibration with reticle according to an embodiment of the present invention.
Figure 18:
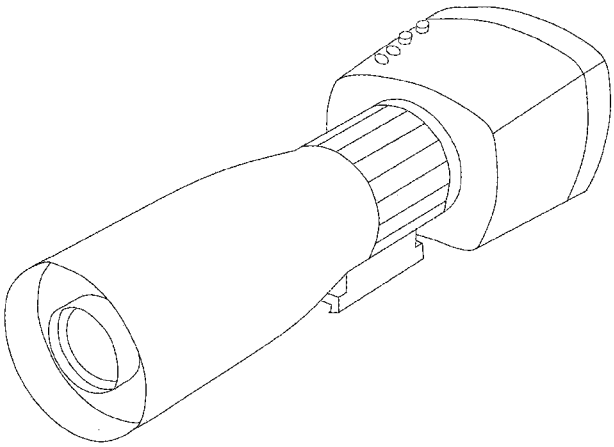
FIG. 18 is a perspective view of an electric sight according to an embodiment of the present invention.
Figure 19:
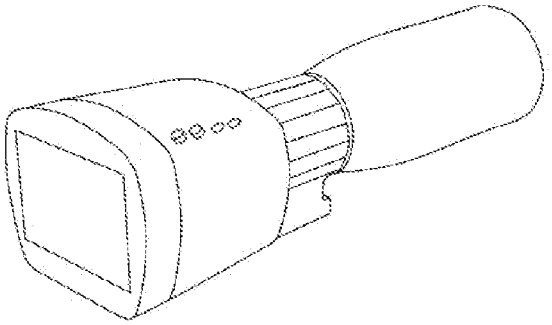
FIG. 19 is a perspective view of an electric sight according to another embodiment of the present invention.

F. As shown in FIG. 11, obtain values of X and Y from step E, divided by the magnification to get calculated point of impact 43 on the touch screen (i.e. visual plane). Identify the calculated point of impact 43 on the touch screen;

G. As shown in FIG. 12, determine the opposite value of the point of impact on the first rectangular coordinate system based on the calculated point of impact 43, click on the opposite value on the touch screen to shift the origin 42 of the rectangular coordinate system 41 to the opposite value, and shift the calculated point of impact 43 to the center point of the touch screen 4 to finish simulative calibration;

H. As shown in FIG. 13, withdraw the first rectangular coordinate system 41 and its origin 42, create a second rectangular coordinate system 45 via the operation panel, the origin 46 of the second rectangular coordinate system 45 coincides with the calculated point of impact 43. As shown in FIG. 14, fire a bullet and observe the first bullet hole 47 on the touch screen 4, lock the display by pressing a key for screen lock on the operation panel;

I. Identify the corresponding bullet hole position 47 on the touch screen 4;

J. Obtain the coordinate of the first bullet hole 47 on the second rectangular coordinate system 45;

K. Obtain the opposite value of the coordinate of the first bullet hole on the second rectangular coordinate system 45;

L. Click on the opposite value on the touch screen 4 to shift the origin of the rectangular coordinate system to the opposite value, and then release the screen lock;

M. As shown in FIG. 15, aim at the target with the shifted origin;

N. As shown in FIG. 16, fire a second bullet, the second bullet hole 48 coincides with the first bullet hole 47 on the touch screen 4 in theory;

O. As shown in FIG. 17, clear the rectangular coordinate system 45 on the touch screen;

P. Click on the second bullet hole 48 on the touch screen 4, shifting the central point of the reticle 49 to the clicked position, and then release the screen lock to finish pre-shooting calibration; Step D to G are simulative calibration, H to P are pre-shooting calibration. Simulative calibration and pre-shooting calibration can perform in sequence from step D to G or choose either one.

Most traditional sight guns aim via different reticles for targets at different distance. For example, targets at a distance of 100 m-200 m and 200 m-300 m are aimed via different reticles. However, for targets at 150 m or 250 m distance, etc., this traditional reticle setting method is inaccurate with reticle center and point of impact far apart from each other.

The present invention discloses an calibration method for an electronic sight. The real-time processor receives environment information values from the information acquisition device. The laser ranging device measures the distance between the targeted object and the sight. The memory stores bullets information. The ballistic curve model calculates bullets ballistic curve based on real-time environment information values, continuous (non-discrete) distance information and bullets information, obtains real-time point of impact to establish and adjust the reticle. When the electronic sight aims at any target at any continuous (non-discrete) distance in any environment, it can adjust the reticle in real time based on ballistic curve model to make the center of reticle close to the point of impact, achieving the same technical effect as non-polar reticles.

The calibration method disclosed in the present invention comprises steps of shifting the touch screen to the calculated point of impact by simulation and pre-shooting calibration, which avoids wasting bullets in an situation that the point of impact cannot be identified after first shot.

What is claimed is:

1. An electronic sight comprising a lens assembly, an image sensor, a processor, a memory, and a touch screen; said lens assembly being connected to said processor via said image sensor; said processor being connected to said touch screen and said memory; said processor being further connected to an information acquisition device, a night vision device, a laser ranging device and a Global Positioning System, wherein said night vision device is rotatably engaged to bottom side of the front end of said lens assembly;

wherein said night vision device comprises an infrared receiving unit, an infrared emitting unit, a photoresistor and a printed circuit board, said printed circuit board being connected to said processor;

wherein said infrared emitting unit, said infrared receiving unit, and said photoresistor is mounted on said printed circuit board, said printed circuit board being fixed on a holder of said night vision device, said holder of said night vision device being fixed on said lens assembly, and wherein said photoresistor detects light intensity value with a night threshold value of 0.3 lux, informing said processor of night mode when light intensity value being lower than 0.3 lux.

2. The electronic sight according to claim 1, wherein said lens assembly comprises a rotating chamber, a boss chamber and a telescopic tube.

3. The electronic sight according to claim 2, wherein said rotating chamber comprises a rotating portion and a non-rotating portion, wherein said rotating portion and said non-rotating portion are connected through a bearing.

4. The electronic sight according to claim 3, wherein said rotating portion of said rotating chamber is rotatably connected to said boss chamber, wherein one end of said telescopic tube is connected to said non-rotating portion of said rotating chamber, the other end of said telescopic tube being connected to said boss chamber.

5. The electronic sight according to claim 4, wherein said non-rotating portion of said rotating chamber comprises a group of reference lenses, wherein said rotating portion of said rotating chamber comprises an outer orbit, said outer orbit being disposed at a junction between said rotating portion and said boss chamber.

6. The electronic sight according to claim 5, wherein said boss chamber comprises a plurality of adjustable lens groups and an inner orbit, said inner orbit being disposed at a junction between said boss chamber said rotating chamber, said outer orbit being surrounded by said inner orbit.

7. The electronic sight according to claim 1, wherein said information acquisition device comprises a wireless receiving unit and a group of sensors, said group of sensors being connected to a receiving unit, said receiving unit being fixed on upper side of the middle part of said lens assembly, said receiving unit being connected to said processor.

8. The electronic sight according to claim 7, wherein said group of sensors comprises a plurality of wind direction and speed sensors, a plurality of temperature sensors and a plurality of humidity sensors, wherein said receiving unit is wireless, wherein said group of sensors is connected to said receiving unit wirelessly.

9. The electronic sight according to claim 8, wherein said wind direction and speed sensor is an ultrasonic wind direction and speed sensor, wherein said humidity sensor is a current humidity sensor.

10. The electronic sight according to claim 1 converts a grayscale image captured by said night vision device to a color image and displays said color image on said touch screen.

11. The electronic sight according to claim 10, wherein said color image is obtained according to a method comprising the steps of:

dividing said touch screen into n×m square units of the same size, side length of said square unit being l, width of said touch screen being n×l, length of said touch screen being m×l, n and m being integers greater than or equal to 100;

extracting edges, said night vision device obtaining and displaying images on said touch screen, comparing brightness of two mutually adjacent said square units, marking the brighter square unit if brightness differs by more than 0.08 lux, obtaining a marked image area, said marked image area being an image area of a targeted object;

filling color to said image area of said targeted object, fill non-targeted areas with another color of big difference;

displaying said targeted object with an image area of i square units;

obtaining optimal shooting area s based on equation $$s = \left(1 - \frac{\sqrt{i}}{n}\right) \cdot i.$$

12. The electronic sight according to claim 1, wherein said laser ranging device comprises a laser emitting unit, a laser receiving unit, a laser central unit, a laser control device and a plurality of power components.

13. The electronic sight according to claim 12, wherein said laser emitting unit, said laser receiving unit, and said laser control unit are connected to said laser central unit, said laser central unit being connected to said processor, said plurality of power components providing electric power to said laser emitting unit, said laser receiving unit, said laser central unit and said laser control unit, wherein said laser emitting unit and said laser receiving unit are fixed on each side of the front end of said lens assembly by a laser holder, wherein said laser holder comprises a manual knob.

14. The electronic sight according to claim 1 further comprises a video recorder, wherein said video recorder is rotatably engaged to bottom side of the middle part of said lens assembly.

15. The electronic sight according to claim 14, wherein said video recorder comprises a video camera, said video camera being engaged to bottom side of said lens assembly and wirelessly connected to said memory, said video camera recording shooting or hunting by video recording or photograph recording, and sending recorded information to a remote terminal via Bluetooth or USB interface.

16. The electronic sight according to claim 1, further comprises an operation panel, said operation panel comprising a power switch, a key for main menu, a key for screen lock, a key for reticle brightness, a key for screen brightness, a key to switch between aiming a stationary object and a non-stationary object, a key for image zoom in and out, a key for work mode selection and a network key.

17. The electronic sight according to claim 1, wherein said processor further comprises an error analysis module, said error analysis module recording manufacturers of bullets used in calibration, calculating standard deviation and displaying error distribution on said touch screen.

18. The electronic sight according to claim 1, further comprises a communication module, said communication module being connected to said remote terminal, said remote terminal being connected to a cloud, said communication module having a capability of uploading images or data stored in said electronic sight to said remote terminal.

19. A method of calibrating a reticle in an electronic sight of claim 1, comprising the steps of:

performing a plurality of initial preparation steps using the electronic sight of claim 1; and performing a simulative calibration or a pre-shooting calibration or said simulative calibration followed by said pre-shooting calibration.

20. The method according to claim 19, wherein said plurality of initial preparation steps comprise:

setting a targeted object at a distance from the electronic sight;

obtaining a first rectangular coordinate system through an operation panel, letting said first rectangular coordinates superimposed on an image of said targeted object displayed on a touch screen, and setting an origin of said first rectangular coordinate system at a center point of said touch screen; and observing said image of said targeted object on said touch screen, and aiming at said targeted object through said origin of said first rectangular coordinate system.

21. The method according to claim 19, wherein said simulative calibration comprises the steps of:

said processor receiving information affecting ballistic curve of bullets;

calculating a bullet offset based on a ballistic curve model in said processor;

obtaining a calculated point of impact based on said bullet offset and identifying said calculated point of impact on said touch screen; and determining an opposite value of said calculated point of impact on said first rectangular coordinate system based on said calculated point of impact, clicking on said opposite value on said touch screen to shift said origin of said rectangular coordinate system to said opposite value, and shifting said calculated point of impact to said center point of said touch screen to finish said simulative calibration.

22. The method according to claim 21, wherein said information affecting ballistic curve of bullets comprise wind direction and speed, temperature and humidity provided by an information acquisition device, latitude and longitude information provided by a GPS, an gravity factor of said latitude and longitude, volume, mass and speed of bullets provided by a memory, distance information between said targeted object and sight electronic sight provided by a laser ranging device.

23. The method according to claim 21, wherein said ballistic curve model is:

$$Y = \left[\frac{V_1 L * \sin\varphi}{V_1 * \cos\varphi - \sqrt{\frac{8kC \cdot SPL}{\pi \cdot M^2}} + V_4} + \left(\frac{1}{2}g + \frac{SPV_2}{M}\right) \cdot \left(\frac{L}{V_1 * \cos\varphi - \sqrt{\frac{8kC \cdot SPL}{\pi \cdot M^2}} + V_4}\right)^2\right] \cdot \gamma$$

$$X = \frac{SPV_3}{2M} \cdot \left(\frac{L}{V_1 * \cos\varphi - \sqrt{\frac{8kC \cdot SPL}{\pi \cdot M^2}} + V_4}\right)^2 \cdot \beta$$

wherein X is a horizontal distance traveled by a bullet, Y is a vertical distance traveled by said bullet, L is a distance between said targeted object and said electronic sight, $V_1$ is speed of said bullet when fired from a barrel, $V_2$ is wind velocity perpendicular to a horizontal plane, being positive in upward direction, $V_3$ is wind velocity on said horizontal plane perpendicular to shooting direction, $V_4$ is wind velocity on said horizontal plane parallel to said shooting direction, being positive in the shooting direction, g is gravitational coefficient of corresponding latitude and longitude, being negative in vertically upward direction, C is a thermodynamic temperature constant, κ is Boltzmann's constant, S is volume of said bullet, M is mass of said bullet, P is a humidity value of corresponding environment, said humidity value is mass of the water vapor (g) per unit volume (cubic meter) of air, γ and β are empirical coefficients.

24. The method according to claim 23, wherein said ballistic curve model obtains real-time point of impact to establish and adjust said reticle based on real-time environment information affecting ballistic curve of bullets, achieving the same technical effect as non-polar reticles.

25. The method according to claim 18, wherein said pre-shooting calibration comprises steps of:

withdrawing said first rectangular coordinate system and said origin, creating a second rectangular coordinate system via said operation panel, a origin of said second rectangular coordinate system coinciding with said calculated point of impact, firing a bullet and observing a first bullet hole on said touch screen, locking said touch screen by pressing a key for screen lock on said operation panel;

identifying said bullet hole on said touch screen;

obtaining a coordinate of the said bullet hole on said second rectangular coordinate system;

obtaining an opposite value of said coordinate of said bullet hole on said second rectangular coordinate system;

clicking on said opposite value on said touch screen to shift said origin of said rectangular coordinate system to said opposite value, and then releasing screen lock;

aiming at a target with said shifted origin;

firing a second bullet, a second bullet hole coinciding with said first bullet hole on said touch screen in theory, locking said touch screen;

clearing said rectangular coordinate system on said touch screen; and clicking on said second bullet hole on said touch screen, shifting center of said reticle to the clicked position, and then releasing screen lock to finish said pre-shooting calibration.

26. An electronic sight comprising a lens assembly, an image sensor, a processor, a memory, and a touch screen; said lens assembly being connected to said processor via said image sensor; said processor being connected to said touch screen and said memory; said processor being further connected to an information acquisition device, a night vision device, a laser ranging device and a Global Positioning System, wherein said lens assembly comprises a rotating chamber, a boss chamber and a telescopic tube, wherein said rotating chamber comprises a rotating portion and a non-rotating portion, wherein said rotating portion and said non-rotating portion are connected through a bearing, wherein said rotating portion is connected to an adjusting unit, said adjusting unit providing a rotational force to said rotating portion, wherein said adjusting unit comprises a driving chip, an adjustable resistor, a microcontroller and an automatic adjusting unit, wherein an adjustable portion of said adjustable resistor is connected to an input port of said microcontroller, an output port of said microcontroller being connected to a driving chip, said driving chip providing a driving force to said rotating portion of said rotating chamber, said adjustable portion of said adjustable resistor being connected to an input port of said automatic adjusting unit, said automatic adjusting unit comprising an output port, said input port of said automatic adjusting unit being connected to said processor, wherein one end of said non-adjustable portion of said adjustable resistor is grounded, another end of said non-adjustable portion of said adjustable resistor being connected to a high voltage level, said high voltage level being connected to a power supply.

* * * * *